United States Patent [19]

Ghandehari

[11] Patent Number: 4,627,898

[45] Date of Patent: Dec. 9, 1986

[54] ELECTROLYTIC PRODUCTION OF PRASEODYMIUM

[75] Inventor: Mohammad H. Ghandehari, Brea, Calif.

[73] Assignee: Union Oil Company of California, Los Angeles, Calif.

[21] Appl. No.: 648,722

[22] Filed: Sep. 7, 1984

[51] Int. Cl.[4] ..... C25C 3/34

[52] U.S. Cl. ..... 204/64 R

[58] Field of Search ..... 204/60, 64 R

[56] References Cited

U.S. PATENT DOCUMENTS 2,961,387 11/1960 Slatin ..... 204/64 R

OTHER PUBLICATIONS

Thoma, Progress in the Science & Technology of the Rare Earths, vol. 2, Pergamon Press, N.Y (1966), p. 110.

E. Morrice and T. A. Henrie, *Electrowinning High--Purity Neodymium, Praseodymium and Didymium Metals from Their Oxides,* U.S. Dept. of the Interior, Bureau of Mines Report of Investigations 6957, May, 1967.

E. Morrice, E. S. Shedd, and T. A. Henrie, *Direct Electrolysis of Rare-Earth Oxides to Metals and Alloys in Fluoride Melts,* U.S. Dept. of the Interior, Bureau of Mines Report of Investigations 7146, Jun. 1968.

E. Morrice and M. M. Wong, "Fused Salt Electrowinning and Electrorefining of Rare-Earth and Yttrium Metals," *Minerals Science Engineering,* vol. 11, Jul. 1979, (pp. 125-136).

*Primary Examiner*—Howard S. Williams

*Attorney, Agent, or Firm*—Dean Sandford; Gregory F. Wirzbicki; Robert A. Franks

[57] ABSTRACT

Praseodymium oxide is electrolyzed, at temperatures at or above the melting point of praseodymium metal, in a molten electrolyte initially consisting essentially of lithium fluoride and praseodymium fluoride. Improved current efficiency is obtained when the weight ratio of lithium fluoride to praseodymium fluoride in the electrolyte is about 0.1 to about 0.4.

10 Claims, No Drawings

ELECTROLYTIC PRODUCTION OF PRASEODYMIUM

BACKGROUND OF THE INVENTION

1. Field of the Invention

This invention relates to the electrolytic preparation of metals from fused baths, and more particularly to the production of praseodymium from praseodymium oxide, in a molten lithium fluoride-praseodymium fluoride electrolyte.

2. Description of the Art

Rare earth metals, once only scientific curiosities, are finding ever-increasing industrial utility. In particular, recently developed rare earth alloy high-strength permanent magnets have greatly increased the demand for certain rare earths having lower atomic numbers, most notably samarium and neodymium. Samarium-cobalt magnets have become particularly important, due to their very high strengths.

The rare earth praseodymium also forms high-strength magnets, when alloyed with cobalt. In addition, praseodymium is useful in magnets as a replacement for some of the samarium in a samarium-cobalt alloy, due to the relatively higher cost of samarium.

Praseodymium metal is frequently prepared by the metallothermic reduction of a praseodymium halide (such as the fluoride), wherein the halide is loaded into a corrosion-resistant container with an active metal, such as calcium metal, then is heated in an inert atmosphere to temperatures above the melting point of praseodymium (about 935° C.), and held at such temperatures until the praseodymium is reduced to the metal. After cooling the reaction mixture to room temperature, the product is separated from active metal halide slag and the container. This procedure has certain disadvantages, including the limited quantity of metal which can be prepared in a batch and the numerous steps which involve personal attention from an operator.

Rare earth metals have been prepared for quite some time by fused salt electrolysis techniques, several such techniques being reviewed by E. Morrice and M. M. Wong, "Fused-Salt Electrowinning and Electrorefining of Rare-Earth and Yttrium Metals," *Minerals Science Engineering,* Vol. 11, July 1979 (pages 125–135). Early techniques involved electrolysis of rare earth chlorides, using electrolytes of molten sodium and potassium chlorides; some investigators avoided undesired reactions of the metal products by conducting the electrolysis below the metal melting point, thus producing rare earth metal sponges or nodules.

Other investigators have used molten fluoride electrolytes to produce rare earth metal directly from rare earth oxides. Results for praseodymium are reported by E. Morrice and T. A. Henrie, *Electrowinning High-Purity Neodymium, Praseodymium, and Didymium Metals from Their Oxides,* U.S. Department of the Interior, Bureau of Mines Report of Investigations 6957, May, 1967. Those workers employed a "thermal gradient" electrolysis cell for the production of praseodymium, in which average electrolyte temperature was 1030° C., but metal product was collected in a cooled area, at an average temperature of 800° C., slightly above the solidus point of the electrolyte. By not maintaining product metal at the high formation temperature, better yields and purity were obtained. The electrolyte used was a mixture of 60 percent by weight $PrF_3$ and 40 percent by weight LiF.

Further information on electrolyzing praseodymium oxide was reported by E. Morrice, E. S. Shedd, and T. A. Henrie, *Direct Electrolysis of Rare-Earth Oxides to Metals and Alloys in Fluoride Melts,* U.S. Department of the Interior, Bureau of Mines Report of Investigations 7146, June, 1968. A similar "thermal gradient" technique was described, and this report appears to restate the data for praseodymium production obtained by Morrice and Henrie, supra.

Both of the described praseodymium oxide-to-praseodymium electrolysis reports were confined to small laboratory-scale, batch procedures. To recover product, it was necessary to completely cool the electrolyte, crush it, and separate the product metal nodules. Such procedures generally are not suitable for large-scale, commercial production undertakings, which normally require more continuous, less labor-intensive production methods.

In order to make a more or less continuous process, however, it is necessary to maintain product metal in a molten state, so that the metal can be withdrawn without otherwise affecting the ongoing electrolysis cell operation. Problems observed with such higher-temperature operation involve both higher levels of corrosivity to cell construction materials and product losses, due to competing reactions in the molten electrolyte. One such competing reaction is reaction of praseodymium metal product and/or oxide feed with the electrolyte to form an oxyfluoride-containing sludge. A symptom of this problem is a reduced current efficiency, since produced metal is subsequently being reacted.

Accordingly, it is an object of the present invention to provide an improved electrolytic method for producing praseodymium metal from praseodymium oxide.

An additional object is to provide such an improved method wherein metal is collected and removed from an electrolysis cell, in a molten state.

A further object is to provide such a method wherein the increased cell temperatures, needed to produce molten metal, do not result in uneconomic current efficiency.

These and other important objects of the invention will more clearly appear from consideration of the following disclosure.

SUMMARY OF THE INVENTION

Praseodymium oxide is introduced into a molten lithium fluoride-praseodymium fluoride salt bath, maintained at temperatures at least about the melting point of praseodymium, and is electrolyzed to form praseodymium metal. By utilizing weight ratios of lithium fluoride to praseodymium fluoride about 0.1 to about 0.4 in the salt bath, improved current efficiency is obtained for the continuous production of praseodymium metal.

DESCRIPTION OF THE INVENTION

The invention pertains to the continuous-flow production of praseodymium metal, by electrolytic reduction of praseodymium oxide in a molten lithium fluoride-praseodymium fluoride electrolyte.

The term "continuous-flow" is used herein to describe methods wherein metal collection is conducted above the melting point of the metal product. It is not necessary for a method to be actually run in a continuous manner to qualify as "continuous-flow," since the capability for periodic or intermittent withdrawals of molten metal is considered to be equivalent to continuous operation.

Current efficiency is determined by calculating the amount of product expected to be formed (1.753 grams praseodymium from $Pr_2O_3$ per ampere-hour) in the cell, and comparing the actual metal product recovery.

Electrolysis cells which are suitable for the practice of the present invention include those which are known in the art, such as the cells described in reports by Morrice et al., supra. Numerous cell configurations are considered useful, utilizing various materials of construction; such matters are not considered to be critical for the successful conduction of the claimed method.

Physical properties of lithium fluoride-praseodymium fluoride mixtures have previously been studied. The melting points of these mixtures were reported by R. E. Thoma, by means of a phase diagram showing the effect of increasing praseodymium fluoride concentration, in L. Eyring (ed.), *Progress in the Science and Technology of the Rare Earths,* Vol. 2, Pergamon Press, New York, 1966, page 110. The diagram expresses concentration in terms of mole percentages; restatement in terms of weight ratios gives the data in Table 1.

TABLE 1

| Weight LiF / Weight $PrF_3$ | Melting Point °C. |
|---|---|
| Pure LiF | 850 |
| 1.180 | 810 |
| 0.524 | 750 |
| 0.439 | 720 |
| 0.400 | 750 |
| 0.306 | 830 |
| 0.197 | 970 |
| 0.131 | 1070 |
| 0.100 | 1130 |

As can be seen in the table, electrolyte compositions of the invention, which have weight ratios of lithium fluoride to praseodymium fluoride between about 0.1 and about 0.4, have melting points between about 750° C. and about 1130° C., the temperature increasing as the proportion of lithium fluoride decreases. Since some of the weight ratios have melting points higher than that of praseodymium metal, it is clear that electrolyte melting point must be considered when choosing operating conditions for practice of the method.

The term "lithium fluoride and praseodymium fluoride" is used herein to describe an electrolyte which initially consists essentially of those compounds. Thus, the term encompasses the relatively pure starting electrolyte, as well as an impure electrolyte as it exists after use to produce praseodymium, it being recognized that electrolyte composition can be significantly altered during use.

Most of the electrolytic cells which have been used to produce lanthanide metals (i.e., elements having the atomic numbers 39 and 59 through 71) utilize carbon anodes, at which the following reactions (1) through (3) are believed to occur during the production of praseodymium from $Pr_2O_3$ or from $Pr_6O_{11}$ ($Pr_2O_3 \cdot 4PrO_2$):

$$Pr_2O_3 + 3/2\ C \rightarrow 2Pr + 3/2\ CO_2 \quad (1)$$

$$PrO_2 + 2C \rightarrow Pr + 2CO \quad (2)$$

$$PrF_3 + \tfrac{3}{4}\ C \rightarrow Pr + \tfrac{3}{4}\ CF_4 \quad (3)$$

with reaction (3) occurring primarily when the praseodymium oxide concentration near the anode becomes very low. Reaction (3) clearly has an effect upon electrolyte composition, by removing fluoride.

Other reactions which can affect the electrolyte composition and/or the current efficiency are those involving the product metal, such as reactions (4) and (5):

$$2\ Pr + 3\ CO_2 \rightarrow Pr_2O_3 + 3\ CO \quad (4)$$

$$2\ Pr + 3\ CO \rightarrow Pr_2O_3 + 3\ C \quad (5)$$

In addition, praseodymium can form the oxide $Pr_6O_{11}$ and can react in the molten electrolyte to form oxyfluorides such as PrOF. The oxyfluorides contribute to the formation of insoluble sludge in the cell, as well as altering electrolyte composition by removing fluoride ions.

The method of the invention utilizes weight ratios of lithium fluoride to praseodymium fluoride in the initial electrolyte composition about 0.1 to about 0.4. These values correspond to molar ratios of lithium fluoride to praseodymium fluoride about 0.76 (melting point about 1130° C.) to about 3.05 (melting point about 750° C.). Preferred weight ratios are in the range about 0.2 to about 0.3. Such ratios provide an electrolysis of improved current efficiency, possibly due to the decreased solubility of molten praseodymium metal in the molten electrolyte and improved metal coalescence.

A general procedure for use of the present invention comprises the steps of:

(a) preparing a molten electrolyte which comprises lithium fluoride and praseodymium fluoride, wherein the weight ratio of lithium fluoride to praseodymium fluoride is about 0.1 to about 0.4;

(b) passing a direct current through the electrolyte, while introducing praseodymium oxide into the electrolyte; and (c) collecting praseodymium metal, at or above the melting point of the metal.

The invention is further illustrated by the following examples, which are illustrative of various aspects of the invention and are not intended as limiting the scope of the invention as defined by the appended claims.

EXAMPLE I

The solubility of praseodymium in molten mixtures of lithium fluoride and praseodymium fluoride is determined by placing a piece of the metal, weighing 1 gram, in a molybdenum foil-lined graphite boat with 50 grams of the salt mixture, heating the boat in a tube furnace for 1 hour, under an argon atmosphere, cooling the boat, and weighing the recovered metal piece.

Results obtained at 950° C. are summarized in Table 2, showing that praseodymium solubility increases as lithium fluoride concentration increases.

TABLE 2

| Weight LiF / Weight $PrF_3$ | Number of Tests | Grams Pr Dissolved Median | Grams Pr Dissolved Mean |
|---|---|---|---|
| 0.667 | 5 | 0.71 | 0.75 |
| 0.250 | 4 | 0.44 | 0.39 |

EXAMPLE II

The effect of electrolyte composition upon current efficiency is measured, using a small cell having a diameter of three inches, a graphite anode and a molybdenum or tungsten cathode.

Electrolysis is conducted at temperatures about 920° C. to about 980° C., with two different electrolyte compositions and for a period of about one hour. A total of 30.0 grams of praseodymium sesquioxide ($Pr_2O_3$) is fed to the cell during the run. Results are summarized in Table 3, showing an increase in cathode current efficiency when the electrolyte lithium fluoride concentration is lowered. This increase, however, is accompanied by a higher voltage drop in the cell.

TABLE 3

| Electrolyte $\frac{\text{Weight LiF}}{\text{Weight PrF}_3}$ | 0.25 | 0.25 | 0.25 | 0.67 | 0.67 |
|---|---|---|---|---|---|
| Total Current (ampere-hours) | 13.5 | 15.0 | 15.0 | 15.0 | 15.0 |
| Grams Metal collected | 18.47 | 18.70 | 20.87 | 5.24 | 9.8 |
| Cell Voltage (volts) | 4.2–4.9 | 4.4–4.7 | 4.5–4.8 | 3.4–3.6 | 3.7–4.1 |
| Cathode Current Efficiency (%) | 78.1 | 71.2 | 79.4 | 19.9 | 37.3 |

EXAMPLE III

A series of experiments, similar to that of the preceding example, shows cathode current efficiency as a function of electrolyte composition. Results, summarized in Table 4, are obtained at cell temperatures about 950° C. and total currents of 15 ampere-hours. This demonstrates the higher efficiency obtained when the electrolyte has a lower concentration of lithium fluoride.

TABLE 4

| $\frac{\text{Weight LiF}}{\text{Weight PrF}_3}$ | Cathode Current Efficiency, percent |
|---|---|
| 0.389 | 43.0, 61.2 |
| 0.316 | 65.3, 72.3, 80.5 |
| 0.250 | 83.0 |
| 0.176 | 78.2, 83.6 |

Various embodiments and modifications of this invention have been described in the foregoing description and examples, and further modifications will be apparent to those skilled in the art. Such modifications are included within the scope of the invention as defined by the following claims.

What is claimed is:

1. A method for preparing praseodymium metal by electrolyzing praseodymium oxide in a molten electrolyte comprising lithium fluoride and praseodymium fluoride, wherein an initial weight ratio of lithium fluoride to praseodymium fluoride is about 0.1 to about 0.4, and collecting said praseodymium metal at temperatures at or above the melting point of the metal.

2. The method defined in claim 1 wherein the weight ratio is about 0.2 to about 0.3.

3. The method defined in claim 1 wherein praseodymium oxide comprises $Pr_2O_3$.

4. The method defined in claim 1 wherein praseodymium oxide comprises $Pr_6O_{11}$.

5. A method for preparing praseodymium metal, comprising the steps of:

(a) preparing a molten electrolyte comprising lithium fluoride and praseodymium fluoride, wherein a weight ratio of lithium fluoride to praseodymium fluoride is about 0.1 to about 0.4;

(b) passing a direct electric current through the electrolyte, while introducing praseodymium oxide into the electrolyte; and (c) collecting praseodymium metal at temperatures at or above the melting point of the metal.

6. The method defined in claim 5 wherein the weight ratio is about 0.2 to about 0.3.

7. The method defined in claim 5 wherein the praseodymium oxide comprises $Pr_2O_3$.

8. The method defined in claim 5 wherein the praseodymium oxide comprises $Pr_6O_{11}$.

9. A method for preparing praseodymium metal, comprising the steps of:

(a) preparing a molten electrolyte consisting essentially of lithium fluoride and praseodymium fluoride, having a weight ratio of lithium fluoride to praseodymium fluoride about 0.1 to about 0.4;

(b) passing a direct electric current through the electrolyte, while introducing $Pr_2O_3$ into the electrolyte; and (c) collecting praseodymium metal at temperatures at least about the melting point of the metal.

10. The method defined in claim 9 wherein the weight ratio is about 0.2 to about 0.3.

* * * * *